US009278828B2

(12) United States Patent
Eto et al.

(10) Patent No.: US 9,278,828 B2
(45) Date of Patent: Mar. 8, 2016

(54) GROUP MANAGEMENT CONTROL DEVICE FOR ELEVATOR

(75) Inventors: Masaharu Eto, Tokyo (JP); Naohiko Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 504 days.

(21) Appl. No.: 13/884,459

(22) PCT Filed: Jan. 26, 2011

(86) PCT No.: PCT/JP2011/051441

§ 371 (c)(1),
(2), (4) Date: May 9, 2013

(87) PCT Pub. No.: WO2012/101770

PCT Pub. Date: Aug. 2, 2012

(65) Prior Publication Data

US 2013/0228399 A1 Sep. 5, 2013

(51) Int. Cl.

| | |
|---|---|
| ***B66B 1/18*** | (2006.01) |
| ***B66B 1/34*** | (2006.01) |
| ***B66B 1/24*** | (2006.01) |

(52) U.S. Cl.

CPC ..... *B66B 1/34* (2013.01); *B66B 1/2458* (2013.01); *B66B 2201/211* (2013.01); *B66B 2201/232* (2013.01)

(58) Field of Classification Search

CPC .. B66B 1/34; B66B 1/2458; B66B 2201/211; B66B 2201/232

USPC ..... 187/247, 380–388, 391–393

See application file for complete search history.

(56) References Cited

U.S. PATENT DOCUMENTS 6,655,501 B2 * 12/2003 Kostka ..... B66B 1/2458 187/247
6,945,365 B2 * 9/2005 Matela ..... B66B 1/20 187/247

(Continued)

FOREIGN PATENT DOCUMENTS

CN 101291864 A 10/2008
JP 3037215 5/1997

(Continued)

OTHER PUBLICATIONS

English Translation of the International Preliminary Report on Patentability and Written Opinion issued Aug. 29, 2013 in PCT/JP2011/051441.

(Continued)

*Primary Examiner* — Anthony Salata
(74) *Attorney, Agent, or Firm* — Oblon, McClelland, Maier & Neustadt, L.L.P.

(57) ABSTRACT

Provided is a group management control device for elevator in which the occurrence of useless waiting time and lateness for boarding is reduced even when there is a difference in the distance from a hall call registration device to each car. For this purpose, the group management control device for elevator which manages a plurality of elevators as a bank includes a hall call registration device, a walking time prediction section which predicts the walking time of a user on the basis of the distance from the hall call registration device to each of the elevators, and a hall call assignment section which decides an elevator to be assigned to a hall call on the basis of an evaluation value calculated by using the predicted walking time. The plurality of elevators which are managed as a bank are divided into a plurality of groups according to the distance from the hall call registration device. The walking time prediction section predicts the walking time for each group by using the same value preset as the distance for the elevators belonging to the same group.

4 Claims, 4 Drawing Sheets

(56) References Cited

U.S. PATENT DOCUMENTS

| | | | | |
|---|---|---|---|---|
| 7,328,775 | B2 * | 2/2008 | Zaharia | B66B 1/18 187/391 |
| 7,849,974 | B2 * | 12/2010 | Stanley | B66B 1/18 187/337 |
| 8,439,169 | B2 * | 5/2013 | Iio | B66B 1/2458 187/387 |
| 8,567,569 | B2 * | 10/2013 | Suzuki | B66B 1/2458 187/247 |
| 8,651,242 | B2 * | 2/2014 | Sarjanen | B66B 1/468 187/388 |
| 8,910,752 | B2 * | 12/2014 | Furutani | B66B 1/468 187/384 |
| 2004/0262092 | A1 | 12/2004 | Wyss et al. | |
| 2009/0120727 | A1 | 5/2009 | Hamaji et al. | |
| 2009/0178890 | A1 | 7/2009 | Sakurai | |
| 2010/0224451 | A1 | 9/2010 | Hikita et al. | |
| 2013/0068568 | A1 * | 3/2013 | Nonami | B66B 1/468 187/381 |
| 2013/0153339 | A1 * | 6/2013 | Sarjanen | B66B 1/468 187/382 |

FOREIGN PATENT DOCUMENTS

| | | | |
|---|---|---|---|
| JP | 11 322205 | | 11/1999 |
| JP | 2005-15228 | A | 1/2005 |
| KR | 10-2007-0088519 | | 8/2007 |
| WO | 2006 114877 | | 11/2006 |
| WO | 2007 052336 | | 5/2007 |
| WO | 2007 096947 | | 8/2007 |
| WO | 10-2008-0020690 | | 3/2008 |

OTHER PUBLICATIONS

International Search Report Issued May 17, 2011 in PCT/JP11/51441 Filed Jan. 26, 2011.

Office Action issued on Nov. 19, 2014 in the corresponding Chinese Patent Application No. 201180061358.X (with Partial English Translation).

Office Action issued on Nov. 11, 2014 in the corresponding Korean patent Application No. 10-2013-7021807 (with English Translation).

Korean Office Action issued May 6, 2015 in Patent Application No. 10-2013-7021807 (with English Translation).

Combined Office Action and Search Report issued Apr. 15, 2014 in Chinese Patent Application No. 201180061358.X (with partial English translation and English translation of Category of Cited Documents).

* cited by examiner

3 : HALL CALL REGISTRATION DEVICE
5a: HALL CALL REGISTRATION SECTION
5b: WALKING TIME PREDICTION SECTION
5c: HALL CALL ASSIGNMENT SECTION
5d: WAITING WITH OPEN DOOR CONTROLLING SECTION
6 : ELEVATOR CONTROLLER

GROUP MANAGEMENT CONTROL DEVICE FOR ELEVATOR

TECHNICAL FIELD

The present invention relates to a group management control device for elevator.

BACKGROUND ART

In conventional elevators, in some cases a hall call registration device is installed in a remote place which is a given distance away from an elevator hall where users get on/off an elevator. In an example in which such a hall call registration device is installed in a place remote from an elevator hall, a security gate is installed in a place leading to the elevator hall, personal authentication is performed during the passage through the security gate, a hall call registration is performed at the same time, and an elevator car is assigned to a user who has passed the security gate. In another example, in an automatically lockable main-entrance door provided in a main entrance to an apartment, such as a condominium, a hall call registration for a main-entrance floor is performed when the main-entrance door is unlocked using a card key and the like.

In the case where a hall call registration device is installed in a place remote from an elevator hall like this, it takes a given time for a user who performed a registration operation to move to the elevator hall (the hall) after performing the hall call registration. Therefore, there has hitherto been known a group management control device for elevator in which an elevator car to be assigned to a hall call is decided in consideration of the walking time of a user from a hail call registration device to an elevator hall.

As such a conventional group management control device for elevator there are known group management control device which are such that in the case where a hall call is registered from a hall call registration device installed in a place remote from a hall, the walking time required by a user to reach the hall is estimated, the arrival time required by an elevator car to arrive at the hall is predicted, an elevator car to be assigned to the hall call is decided on the basis of the estimated walking time and the predicted arrival, and when the assigned elevator car arrives at the hall and the door opens, this elevator car is caused to wait, with the door kept open, until the estimated walking time elapses (refer to Patent Literature 1, for example).

Also, there are known group management control device for elevator which are such that in the case where a hall call is registered from a hall call registration device installed in a place remote from a hall, if the arrival time required by an elevator car to arrive at the hall is shorter than the predicted walking time required by a user to reach the hall, the user who is already present in the car or the hall is provided with information to that effect (refer to Patent Literature 2, for example).

Furthermore, there are known group management control device for elevator which are such that in the case where a hall call is registered from a hall call registration device installed in a place remote from a hall, when an elevator car assigned to the hall call in question has already arrived at the hall and the door is open, the walking time required by a user to reach the hall is calculated, and the elevator car in question is caused to wait, with the door kept open, until this walking time elapses (refer to Patent Literature 3, for example).

CITATION LIST

Patent Literature

Patent Literature 1: International Publication No. WO2006/114877 Pamphlet

Patent Literature 1: International Publication No. WO2007/052336 Pamphlet

Patent Literature 3: International Publication No. WO2007/096947 Pamphlet

SUMMARY OF INVENTION

Technical Problem

As described above, in the conventional group management control device for elevator described in Patent Literature 1 to Patent Literature 3, in the case where a hall call is registered from a hall call registration device installed in a place remote from a hall, until the predicted walking time required by a user to reach the hall elapses, an elevator car assigned to the hall call in question is caused to wait, with the door kept open, in the hall or a user who is already in the car is provided with information, whereby the user is prevented from becoming late for boarding.

However, in particular, in the case where the number of elevator cars is large and the elevators have a wide elevator hall, the difference in the distance from a hall call registration device to each of the elevator cars can be large depending on the arrangement of a group of elevator cars controlled by the group management control device. And if the difference in the distance from a hall call registration device to each of the elevator cars is large, in the case where the walking time of a user is predicted on the basis of the distance from the hall call registration device to the hall, differences between an actual walking time to an elevator car at a short distance from the hall call registration device and, inversely, to a remote elevator car and a predicted walking time become large.

Therefore, for an elevator car at a short distance from the hall call registration device, the user arrives at the entrance to the elevator car earlier than the predicted walking time and the waiting time until the departure of the elevator car becomes uselessly long, thus posing a problem. And inversely, for an elevator car at a long distance from the hall call registration device, the user arrives at the entrance to the elevator car later than the predicted walking time and the user become late for the departure of the elevator car and cannot board the elevator car, posing also a problem. And there occurs the problem that the operation efficiency of the elevator worsens due to the occurrence of useless waiting time and lateness for boarding as described above.

The present invention was made to solve the problems described above and provides a group management control device for elevator which is such that, in the case where a hall call registration device is installed in a place remote from an elevator hall (a hall), and there is a difference in the distance from the hall call registration device to each elevator car, it is possible to increase predicted accuracy of the walking time from the hall call registration device to each elevator car and it is possible to prevent the worsening of the operation efficiency by reducing the occurrence of useless waiting time and lateness for boarding.

Means for Solving the Problems

A group management control device for elevator according to the present invention, which manages a plurality of elevators as a bank, comprises: a hall call registration device by use of which a user registers a hall call; a walking time prediction section which predicts a walking time required by the user to reach the entrance to each of the elevators from the hall call registration device on the basis of the distance from the hall call registration device to the entrance to each of the elevator; and a hall call assignment section which decides the elevator to be assigned to the registered hall call on the basis of an evaluation value calculated by using the walking time predicted by the walking time prediction section, wherein the plurality of elevators managed as a bank are divided into a plurality of groups according to the distance from the hall call registration device, and the walking time prediction section predicts the walking time for each of the groups by using the same value preset as the distance for the elevators belonging to the same group.

Advantageous Effect of Invention

Even in the case where there is a difference in the distance from a hall call registration device to each elevator car, the group management control device for elevator of the present invention produces the effects that it is possible to increase the accuracy of prediction of the walking time from the hall call registration device to each elevator car and that it is possible to prevent the worsening of the operation efficiency by reducing the occurrence of useless waiting time and lateness for boarding.

DESCRIPTION OF EMBODIMENTS

The present invention will be described with reference to the accompanying drawings. In each of the drawings, like numerals refer to like or corresponding parts and overlaps of description of these parts are appropriately simplified or omitted.

Embodiment 1

Figure 1:
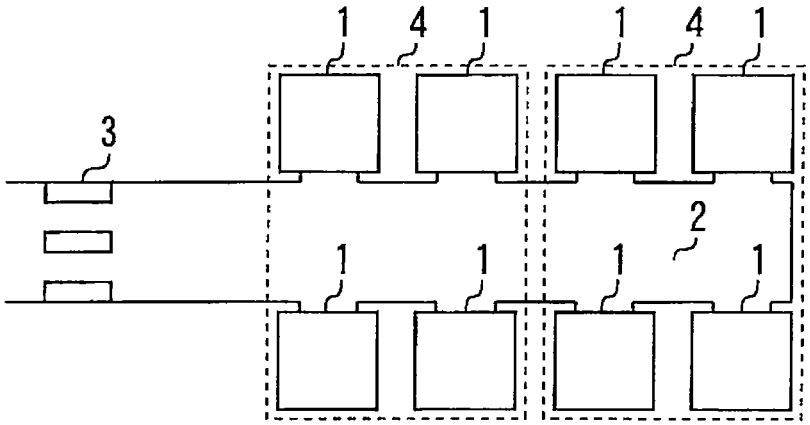
FIG. 1 is a plan view of an elevator hall relating to Embodiment 1 of the present invention.
Figure 2:
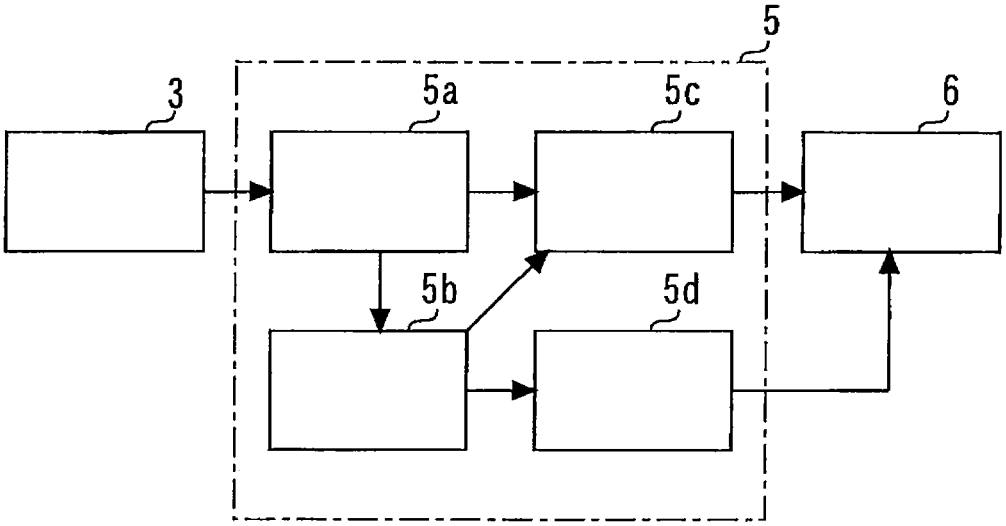
FIG. 2 is a block diagram showing the general configuration of a group management control device for elevator relating to Embodiment 1 of the present invention.
Figure 3:
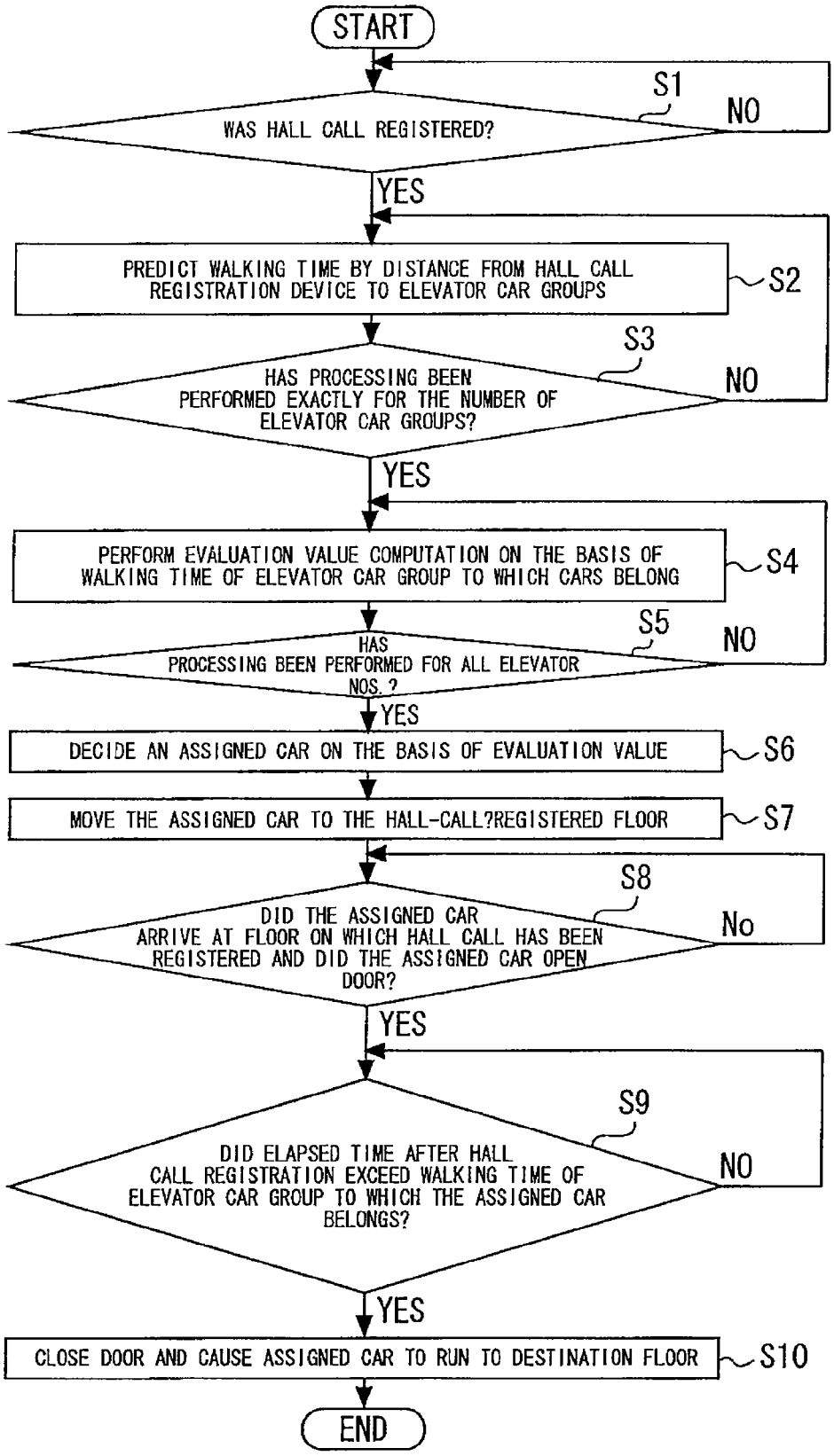
FIG. 3 is a flowchart showing the actions of the group management control device for elevator relating to Embodiment 1 of the present invention.

FIGS. 1 to 3 relate to Embodiment 1 of the present invention. FIG. 1 is a plan view of an elevator hall, FIG. 2 is a block diagram showing the general configuration of a group management control device for elevator, and FIG. 3 is a flowchart showing the actions of the group management control device for elevator.

In FIG. 1, reference numeral 1 denotes a plurality of installed elevator cars which ascend and descend, with users, baggage and the like loaded thereon. And reference numeral 2 denotes an elevator hall where users get on/off the plurality of elevators cars 1. This elevator hall 2 is provided with entrances to each of the plurality of elevator cars 1.

A hall call registration device 3 is installed in a place leading to the elevator hall 2, which is a remote place distant from the elevator hall 2 over a prescribed distance. A user registers a hall call using this hall call registration device 3. The hall call registration device 3 may also have the function of a security gate which, for example, makes a judgment by personal authentication as to whether or not a user who is going to pass the security gate has the authority to pass the security gate and prevents the passage of a user who does not have the authority to pass the security gate.

The operation of a plurality of elevator cars 1 is managed as a bank. And the plurality of elevator cars 1 managed as a bank are further divided into a plurality of elevator car groups 4 according to the distance from the hall call registration device 3 to the entrances to the elevator cars 1 in the elevator hall 2. At least one elevator car 1 belongs to each elevator car group 4. And elevator cars 1 with a distance from the hall call registration device 3 to the entrances to cars which is in a prescribed certain range belong to the same elevator car group 4.

Here, in an example, out of eight elevator cars 1, in FIG. 1 the four elevator cars 1 on the left as you face the drawing are classified as an elevator car group 4 at a relatively short distance from the hall call registration device 3. And the four elevator cars 1 on the right as you face the drawing are classified as an elevator car group 4 at a relatively long distance from the hall call registration device 3.

FIG. 2 shows the general configuration of the group management control device for elevator. A plurality of elevator cars 1 are managed by the group management control device main unit 5 of elevators as a bank. And the operation of each of the plurality of elevator cars 1 is managed by an elevator controller 6 provided for each of the elevator cars 1. The elevator controller 6 controls the operation of each of the elevator cars 1 under the control of the group management control device main unit 5.

The group management control device main unit 5 is provided with a hall call registration section 5*a*, a hall call assignment section 5*c*, a walking time prediction section 5*b*, and a waiting with open door controlling section 5*d*.

Information from the hall call registration device 3 is inputted to the hall call registration section 5*a* of the group management control device main unit 5. This hall call registration section 5*a* is intended for registering a hall call to the floor on which the hall call registration hall call registration device 3 is installed (hereinafter referred to as "the hall-call-registered floor") on the basis of this inputted information from the hall call registration device 3.

The walking time prediction section 5*b* is intended for predicting the walking time required by a user to reach the entrance to the elevator car 1 belonging to the elevator car group 4 from the hall call registration device 3 on the basis of the distance from the hall call registration device 3 to each of the elevator car groups 4 when a hall call is registered by the hall call registration section 5*a*.

As the moving distance of a user used in this prediction of the walking time, the same value is used in the elevator cars 1 belonging to the same elevator car group 4. That is, for each of the elevator car groups 4, a representative value of the distance from the hall call registration device 3 is set beforehand. It is possible to conceive using, for example, an average value of the distance for the hall call registration device 3 to the entrance to each of the elevator cars 1 belonging to the same elevator car group 4 as a representative value of the distance from the hall call registration device 3 to each of the elevator car groups 4. Or alternatively, in the case where priority is given to the prevention of lateness for boarding, it is possible to use a maximum value of the distance from the hall call registration device 3 to the entrance to each of the elevators cars 1 belonging to the same elevator car group 4.

The hall call assignment section 5*c* is intended for deciding an elevator car 1 (an assigned car) to be assigned to a registered hall call when this hall call is registered by the hall call registration section 5*a*. The decision of an assigned car by this hall call assignment section 5*c* is performed on the basis of an evaluation value calculated from the present position of each elevator car 1, the walking time predicted by the walking time prediction section 5*b* and the like in such a manner that an optimum car assignment in terms of the transportation efficiency of the elevator is carried out.

The waiting with open door controlling section 5*d* is intended for causing an assigned car which arrived at a hall-call-registered floor to wait, with the door kept open, on the hall-call-registered floor until the walking time predicted by the walking time prediction section 5*b* elapses after the registration of a hall call by the hall call registration device 3 via the hall call registration section 5*a*.

On the basis of information on an assigned car from the hall call assignment section 5*c*, the elevator controller 6 causes the assigned car in question to run to a hall-call-registered floor (causes the assigned car to respond to the hall call). And on the basis of an instruction for waiting with door open from the waiting with open door controlling section 5*d*, the elevator controller 6 causes the assigned car in question to wait, with the door kept open, on a hall-call-registered floor until the walking time predicted by the walking time prediction section 5*b* elapses.

In carrying out this embodiment, the group management control device for elevator acts according to the flow of a series of actions shown in FIG. 3.

First, in Step S1, it is ascertained whether or not a hall call was registered in the hall call registration section 5*a* at an input from the hall call registration device 3. And when a hall call is registered, the flow of actions proceeds to Step S2. In Step S2, the walking time prediction section 5*b* predicts the walking time from the hall call registration device 3 to the entrance to the elevator car 1 belonging to the elevator car group 4 on the basis of the distance from the hall call registration device 3 to each elevator car group 4.

In succeeding Step S3, it is ascertained whether or not the processing for the prediction of the walking time in Step S2 has been finished exactly for the number of elevator car groups 4, that is, whether or not the processing for the prediction of the walking time in Step S2 for all of the elevator car groups 4 has been finished. In the case where the processing for the prediction of the walking time for all of the elevator car groups 4 has not been finished as yet, the flow of actions proceeds to Step S2, where the prediction of the walking time is performed for the elevator car groups 4 for which the prediction of the walking time has not been finished as yet. In the case where the prediction of the walking time has been finished for all of the elevator car groups 4, the flow of actions proceeds to Step S4.

In Step S4, the hall call assignment section 5*c* computes an evaluation value for each of the elevator car groups 1 on the basis of the walking time for the elevator car group 4 to which the elevator car 1 belongs. And in Step S5, it is ascertained whether or not the processing for the computation of an evaluation value in Step S4 has been competed for all Elevator Nos. of the elevator car 1. In the case where the processing for the computation of an evaluation value has not been completed as yet for all Elevator Nos., the flow of steps returns to Step S4, where the computation of an evaluation value is performed for elevator cars 1 for which the computation of an evaluation value has not been performed as yet. In the case where the processing for the computation of an evaluation value has been finished for all Elevator Nos., the flow of actions proceeds to Step S6.

In Step S6, the hall call assignment section 5*c* decides an assigned car to the hall call registered on the basis of the calculated evaluation value. In succeeding Step S7, the elevator controller 6 causes the assigned car in question to run to a hall-call-registered floor on the basis of the information on the assigned car from the hall call assignment section 5*c*. And the flow of actions proceeds to Step S8, where it is ascertained whether or not the assigned car in question has arrived at the hall-call-registered floor and has opened the door thereof. In the case where the assigned car in question has arrived at the hall-call-registered floor and has opened the door thereof, the flow of actions proceeds to Step S9.

In Step S9, the waiting with open door controlling section 5*d* ascertains whether or not the elapsed time after the registration of the hall call exceeded the walking time predicted by the walking time prediction section 5*b* for the elevator car group 4 to which the assigned car in question belongs. Until the elapsed time after the registration of the hall call exceeds the predicted walking time, an instruction for waiting with door open is outputted from the waiting with open door controlling section 5*d*, and the assigned car is caused to wait, with the door kept open, on the hall-call-registered floor.

And when the elapsed time after the registration of the hall call exceeds the predicted walking time, the flow of actions proceeds to Step S10. In Step S10, the waiting with open door controlling section 5*d* causes the waiting with open door of the car in question to be finished. And the elevator controller 6 causes the assigned car in question to close the door thereof and causes the assigned car in question to run to the destination floor for which the call was registered.

All that required is that the hall call registration device 3 is installed not only as a security gate, but also, for example, as a device which registers a hall call or a hall car call by the operation of a user, such as a hall car call operating panel, a hall button, a card reader, and a fingerprint identification device.

Although here the description was given of the case where the hall call registration device 3 is installed in a place remote from the elevator hall 2, if for example the elevator hall 2 is wide and there is a difference in the distance from the hall call registration device 3 to the entrances to the elevator cars 1, it is not always necessary that the hall call registration device 3 be installed in places remote from the elevator hall 2. There can arise cases where the hall call registration device 3 is installed in close proximity to the elevator hall 2 (one of the elevator car groups 4).

In the group management control device for elevator configured as described above, a plurality of elevators managed as a bank are divided into a plurality of groups according to the distance from the hall call registration device, and for the elevators belonging to the same group, the walking time required by a user to reach the entrance to an elevator from the hall call registration device is predicted for each group using the same value which is set beforehand as the distance from the hall call registration device from the entrances to the elevators.

For this reason, even in the case where there is a difference in the distance from the hall call registration device to each elevator car, it is possible to increase the accuracy of prediction of the walking time from the hall call registration device to each elevator car and hence it is possible to make the easiness with which a user boards any elevator car uniform.

And it is possible to suppress the worsening of the operation efficiency by reducing the occurrence of useless waiting time and lateness for boarding.

Embodiment 2

Figure 4:
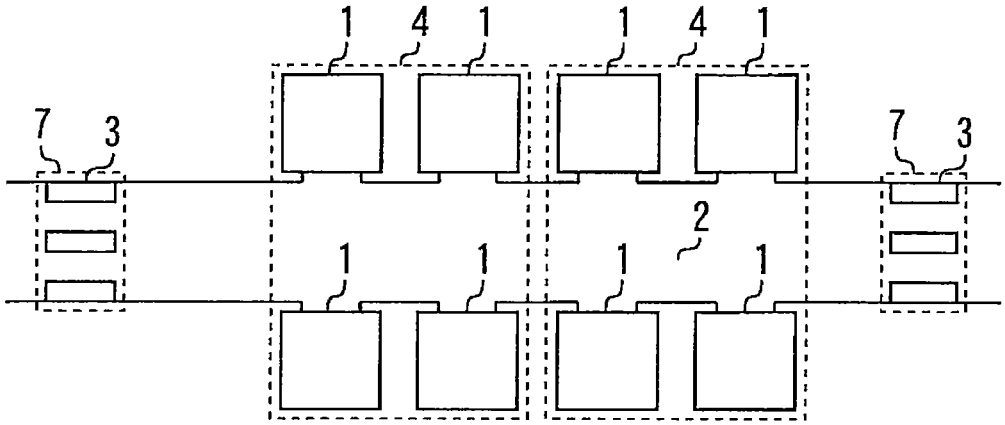
FIG. 4 is a plan view of an elevator hall relating to Embodiment 2 of the present invention.
Figure 5:
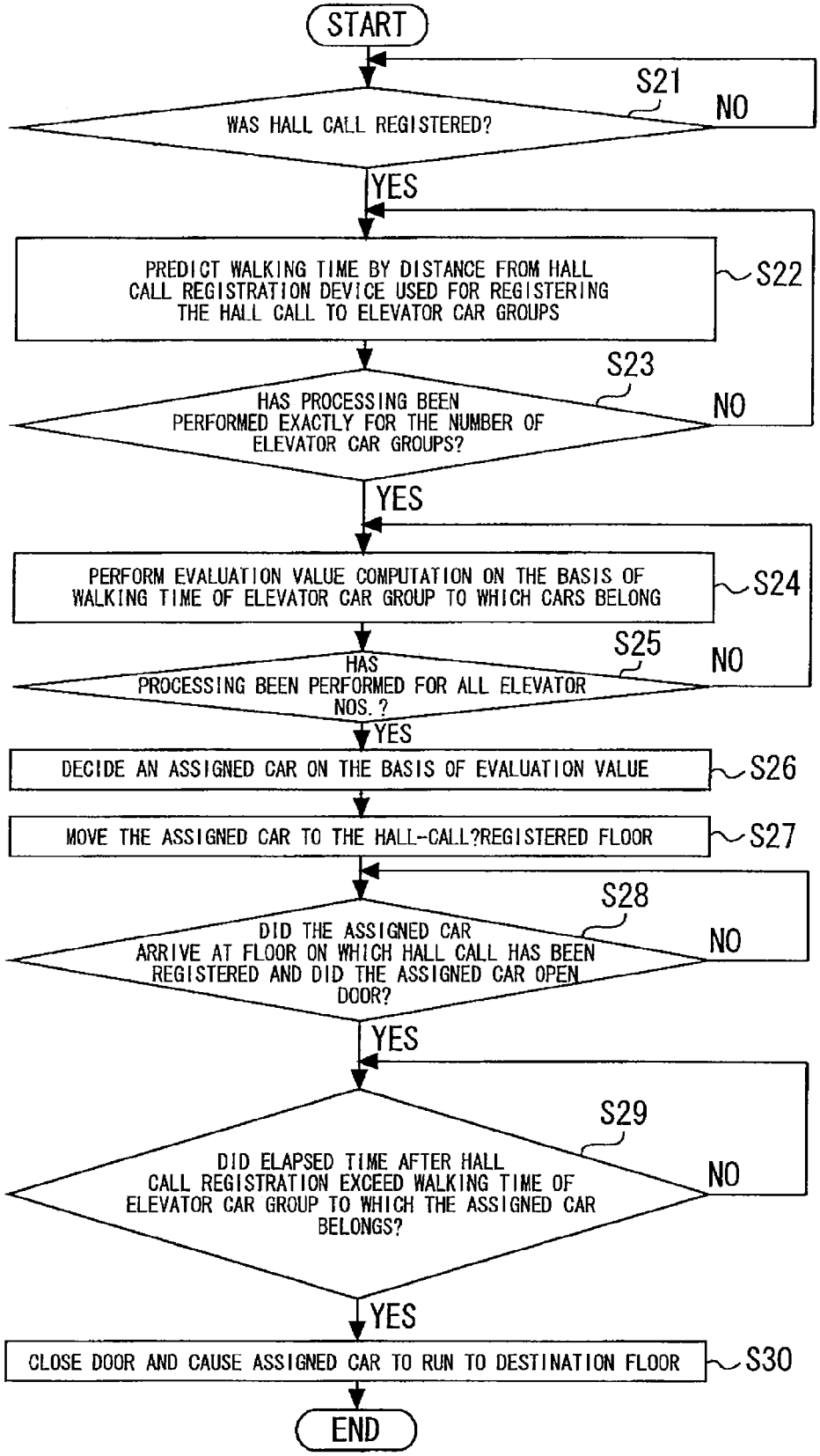
FIG. 5 is a flowchart showing the actions of the group management control device for elevator relating to Embodiment 2 of the present invention.

FIGS. 4 and 5 relate to Embodiment 2 of the present invention. FIG. 4 is a plan view of an elevator hall and FIG. 5 is a flowchart showing the actions of the group management control device for elevator.

In Embodiment 1 described above, the hall call registration device is installed only in one place leading to an elevator hall. In contrast to this, in Embodiment 2 which will be described here, the hall call registration device is installed in a plurality of places on the same floor leading to an elevator hall.

That is, in FIG. 4, there are two ways, one on the left and the other on the right as you face the drawing, which lead to the elevator hall 2 on the same floor. And the hall call registration device 3 is installed in each of these two places. The hall call registration devices 3 installed in each of the plurality places (here, two places) on the same floor are divided into the hall call registration device groups 7 according to the installation places thereof.

Here, as an example, the hall call registration device 3 on the left as you face the drawing is classified as the hall call registration device group 7 at a relatively long distance from the elevator hall 2. And the hall call registration device 3 on the right as you face the drawing is classified as the hall call registration device group 7 at a relatively short distance from the elevator hall 2.

And when a hall call is registered by the hall call registration section 5*a*, the walking time prediction section 5*b* predicts the walking time required by a user to move over the distance from the hall call registration device group 7, to which the hall call registration device 3 for which a registration operation of the hall call in question has been performed belongs, to each elevator car group 4. The moving distance used in this prediction of the walking time is set beforehand for each of combinations of the elevator car groups 4 and the hall call registration device groups in the same manner as in Embodiment 1.

Other configurations are the same as in Embodiment 1 and detailed descriptions thereof are omitted.

In this embodiment, the group management control device for elevator acts according to the flow of a series of actions shown in FIG. 5.

First, in Step S21, it is ascertained whether or not a hall call was registered in the hall call registration section 5*a* at an input from the hall call registration device 3. And when a hall call is registered, the flow of actions proceeds to Step S22. In Step S22, the walking time prediction section 5*b* predicts the walking time from the hall call registration device 3 to the entrance to the elevator car 1 belonging to the elevator car group 4 on the basis of the distance from the hall call registration device group 7, to which belongs the hall call registration device 3 by use of which the hall call registration operation was performed, to each elevator car group 4.

In succeeding Step S23, it is ascertained whether or not the processing for the prediction of the walking time in Step S22 has been finished exactly for the number of elevator car groups 4, that is, whether or not the processing for the prediction of the walking time in Step S22 for all of the elevator car groups 4 has been finished. In the case where the processing for the prediction of the walking time for all of the elevator car groups 4 has not been finished as yet, the flow of actions returns to Step S22, where the prediction of the walking time is performed for the elevator car groups 4 for which the prediction of the walking time has not been finished as yet. In the case where the prediction of the walking time has been finished for all of the elevator car groups 4, the flow of actions proceeds to Step S24.

In Step S24, the hall call assignment section 5*c* computes an evaluation value for each of the elevator car groups 1 on the basis of the walking time for the elevator car group 4 to which the elevator car 1 belongs. And in Step S25, it is ascertained whether or not the processing for the computation of an evaluation value in Step S24 has been competed for all Elevator Nos. of the elevator car 1. In the case where the processing for the computation of an evaluation value has not been completed as yet for all Elevator Nos., the flow of steps returns to Step S24, where the computation of an evaluation value is performed for elevator cars 1 for which the computation of an evaluation value has not been performed as yet. In the case where the processing for the computation of an evaluation value has been finished for all Elevator Nos., the flow of actions proceeds to Step S26.

In Step S26, the hall call assignment section 5*c* decides an assigned car to the hall call registered on the basis of the calculated evaluation value. In succeeding Step S27, the elevator controller 6 causes the assigned car in question to run to a hall-call-registered floor on the basis of the information on the assigned car from the hall call assignment section 5*c*. And the flow of actions proceeds to Step S28, where it is ascertained whether or not the assigned car in question has arrived at the hall-call-registered floor and has opened the door thereof. In the case where the assigned car in question has arrived at the hall-call-registered floor and has opened the door thereof, the flow of actions proceeds to Step S29.

In Step S29, the waiting with open door controlling section 5*d* ascertains whether or not the elapsed time after the registration of the hall call exceeded the walking time predicted by the walking time prediction section 5*b* for the elevator car group 4 to which the assigned car in question belongs. Until the elapsed time after the registration of the hall call exceeds the predicted walking time, an instruction for waiting with door open is outputted from the waiting with open door controlling section 5*d*, and the assigned car is caused to wait, with the door kept open, on the hall-call-registered floor.

And when the elapsed time after the registration of the hall call exceeds the predicted walking time, the flow of actions proceeds to Step S30. In Step S30, the waiting with open door controlling section 5*d* causes the waiting with open door of the car in question to be finished. And the elevator controller 6 causes the assigned car in question to close the door thereof and causes the assigned car in question to run to the destination floor where the call was registered.

The group management control device for elevator configured as described above is such that in the configuration of Embodiment 1, in the case where the hall call registration device is provided in a plurality of places on the same floor, the plurality of hall call registration devices are divided according to installation places thereof into a plurality of hall call registration device groups, and the walking time required by a user to reach the entrance to an elevator from the hall call registration device is predicted for each of the hall call registration device groups using a value set beforehand, as the distance from the hall call registration device to the entrance to the elevator, for each combination of the plurality of hall call registration device groups and the plurality of groups.

For this reason, it is possible to produce the same effect as in Embodiment 1, and in addition, it is possible to increase the accuracy of prediction of the walking time from the hall call registration device to each elevator car in the case where the hall call registration device is installed in a plurality of places on the same floor.

INDUSTRIAL APPLICABILITY

The present invention can be used in a group management control device for elevator which manages a plurality of elevators as a bank and in which an elevator is assigned to a hall call by predicting the walking time required by a user to reach the entrance to an elevator from the hall call registration device.

DESCRIPTION OF SYMBOLS

1 elevator car
2 elevator hall
3 hall call registration device
4 elevator car group
5 group management control device main unit
5*a* hall call registration section
5*b* walking time prediction section
5*c* hall call assignment section
5*d* waiting with open door controlling section
6 elevator controller
7 hall call registration device group

The invention claimed is:

1. A group management control device for elevator which manages a plurality of elevators as a bank, comprising:

a hall call registration device by use of which a user registers a hall call;

a walking time prediction section which predicts a walking time required by the user to reach the entrance to each of the elevators from the hall call registration device on the basis of the distance from the hall call registration device to the entrance to each of the elevator; and a hall call assignment section which decides the elevator to be assigned to the registered hall call on the basis of an evaluation value calculated by using the walking time predicted by the walking time prediction section, wherein the plurality of elevators managed as a bank are divided into a plurality of groups according to the distance from the hall call registration device, and the walking time prediction section predicts the walking time for each of the groups by using the same value preset as the distance for the elevators belonging to the same group.

2. The group management control device for elevator according to claim 1, wherein the hall call registration devices are provided in a plurality of places on the same floor and divided into a plurality of hall call registration device groups according to installation places of each of the hall call registration devices, and the walking time prediction section predicts the walking time for each of the hall call registration device groups by using a value preset as the distance for each of combinations of the plurality of hall call registration device groups and the plurality of groups.

3. The group management control device for elevator according to claim 1, further comprising:

a waiting with open door controlling section which causes the elevator assigned by the hall call assignment section to wait, with the door kept open, on a hall-call-registered floor until the walking time predicted by the walking time prediction section elapses after the registration of the hall call.

4. The group management control device for elevator according to claim 2, further comprising:

a waiting with open door controlling section which causes the elevator assigned by the hall call assignment section to wait, with the door kept open, on a hall-call-registered floor until the walking time predicted by the walking time prediction section elapses after the registration of the hall call.

* * * * *